US006038885A

United States Patent [19]

Corduan et al.

[11] Patent Number: 6,038,885

[45] Date of Patent: Mar. 21, 2000

[54] AIR SEPARATION PROCESS

[75] Inventors: Horst Corduan, Puchheim; Stefan Lochner, Grafing, both of Germany

[73] Assignee: Linde Aktiengesellschaft, Germany

[21] Appl. No.: 09/126,150

[22] Filed: Jul. 30, 1998

[30] Foreign Application Priority Data

Jul. 30, 1997 [DE] Germany ..... 197 32 887

[51] Int. Cl.[7] ..... F25J 3/00

[52] U.S. Cl. ..... 62/653; 62/654

[58] Field of Search ..... 62/640, 641, 644, 62/653, 654, 652

[56] References Cited

U.S. PATENT DOCUMENTS

| | | | |
|---|---|---|---|
| 3,059,439 | 10/1962 | First et al. | 62/654 |
| 5,209,070 | 5/1993 | Darredeau . | |
| 5,265,429 | 11/1993 | Dray . | |
| 5,408,831 | 4/1995 | Guillard et al. . | |
| 5,526,647 | 6/1996 | Grenier | 62/654 |
| 5,566,556 | 10/1996 | Ekins et al. | 62/654 |
| 5,692,396 | 12/1997 | Rathbone | 62/646 |

FOREIGN PATENT DOCUMENTS

| | | | |
|---|---|---|---|
| 0 504 029 B1 | 9/1992 | European Pat. Off. . | |
| 556861 | 8/1993 | European Pat. Off. | 62/654 |
| 0 681 153 A1 | 11/1995 | European Pat. Off. . | |
| 0 848 220 A1 | 6/1998 | European Pat. Off. . | |
| 929798 | 5/1963 | United Kingdom . | |

*Primary Examiner*—William Doerrler
*Attorney, Agent, or Firm*—Evenson, McKeown, Edwards & Lenahan, P.L.L.C.

[57] ABSTRACT

A process and a system for the low-temperature separation of air by rectification is provided. A liquid fraction is obtained in a rectifying system, stored in a tank and at least a portion of the liquid fraction taken out of the tank and brought to an increased pressure. During normal operation, the liquid fraction, which was brought to an increased pressure, is heated in a preheat exchanger and evaporated in the main heat exchanger. During an operating disturbance, at least a portion of the liquid product is removed from the tank, evaporated and used for an emergency supply.

18 Claims, 2 Drawing Sheets

AIR SEPARATION PROCESS

BACKGROUND AND SUMMARY OF THE INVENTION

This application claims the priority of German Patent No. 197 32 887.3, filed Jul. 30, 1997, the disclosure of which is expressly incorporated by reference herein.

The present invention relates to a process and an arrangement for obtaining a product gas under an increased pressure via the low-temperature separation of air by rectification, an emergency supply being provided.

The product gas obtained in an air separation system is frequently required to be under increased pressure. The pressure of the product gas may be increased either by a secondary compression of the gaseous product using a compressor or a pressure increase of the obtained product in the liquid state and a subsequent evaporation. This latter process is known as "internal compression" and, compared to gaseous product compression, offers the advantage of lower equipment costs.

Also, known are certain air separation systems which, in the event of an operating disturbance caused by a malfunctioning pump or other operational failure, ensure an emergency supply of product gas. These air separation systems require additional system components: a storage tank, into which a portion of the liquid product is guided during normal operation; and an emergency evaporator and a pump by means of which the liquid can be pumped as needed from the tank to the emergency evaporator and can be evaporated there.

U.S. Pat. No. 5,566,556 discloses a process for obtaining gaseous pressure products by internal compression. For example, liquid oxygen is removed from the sump of a low-pressure column and either intermediately stored in a liquid-oxygen tank or placed under an increased pressure by means of a pump and is evaporated in a main heat exchanger and heated to an ambient temperature. The oxygen stored in the tank can optionally be evaporated in an auxiliary evaporator and can be used for the emergency supply.

As a rule, a high-pressure air flow, which is used as a main heat transfer medium and is throttled to a lower pressure behind the main heat exchanger, called "throttle flow", and a flow, which in the following will be called "separation air flow", are guided through the main heat exchanger. The latter air flow is maximally cooled to its dew point and in the gaseous state is fed to the pressure column, while the throttle flow is usually guided into the rectification in a liquid state. The selected terms do not indicate that the throttle flow is not also separated by rectification.

If the internally compressed liquid flows are significantly colder than the corresponding product flows from the rectification, during the evaporation of the internally compressed flows in the main heat exchanger, the problem may arise that separation air, fed into the pressure column in a gaseous state, liquifies at the cold end of the main heat exchanger. This will have a negative effect on the rectification.

It is an object of the present invention to provide a process of the initially mentioned type which is cost-effective and can be technically implemented easily as well as a corresponding system which are provided with an emergency supply and an internal compression and can be operated as flexibly as possible.

These objects and others are achieved by the present invention.

In the process of the present invention, the charged air to be separated is compressed and then cooled in a main heat exchanger system in indirect heat exchange with one or several flows. The cooled air is directed to a rectifying system in which one or more fractions are obtained. At least one liquid fraction is intermediately stored in a tank. According to the requirements, a corresponding portion of the liquid is removed from the tank and the pressure of this liquid is increased by means of a suitable device. During normal operation, the liquid, under an increased pressure, is preheated in a preheat exchanger, and is subsequently evaporated in the main heat exchanger system. The resulting gaseous pressure product is then supplied for its intended use.

The term "preheat exchanger" relates to the function of a heat exchanger block or of a section of a heat exchanger block. The preheat exchanger and the main heat exchanger need not be two different components. They may be constructed as separate heat exchanger blocks or integrated in a joint heat exchanger block. Importantly, the liquid under increased pressure is heated in a preheat exchanger to such a degree that a liquefaction of the gaseous separation air is avoided in the main heat exchanger.

Should an operating disturbance of the low-temperature air separation system occur, the liquid stored in the tank, by means of the device for increasing the pressure, is pumped not into the preheat exchanger but into an emergency evaporator and evaporated. The gaseous product obtained in the emergency evaporator can then be transported to the corresponding application sites in order to ensure the emergency supply.

An operating disturbance includes all operating conditions in which the quantity or quality of the generated separation products does not satisfy the demand for these products. This may be caused, for example, by failures or the malfunctioning of system components. Also, for our purposes, a temporarily increased demand for one or several rectification products is treated as a disturbance of the normal operation of the system. Thus, when the momentarily obtained product quantity does not satisfy the demand, the emergency supply ensures a sufficient supply of the gaseous product.

Any device for storing liquid can be used as the tank. It may be arranged inside or outside the low-temperature air separation system. The pressure increase of the liquid fraction may be achieved, for example, by means of a pump downstream of the tank or by changing the static level of the liquid.

The present invention combines a process for producing a gaseous pressure product via internal compression with a process for providing the emergency supply. For previous processes, in which the internal compression and the emergency supply are independent of one another, a separate pump and corresponding pipes and valves are required for the internal compression of the liquid product and for the emergency supply. As a result of the combination according to the invention, the equipment expenditures are clearly reduced.

The liquid fraction, which was brought to an increased pressure, is preferably heated in an indirect heat exchange with a fraction obtained from the rectifying system. Preferably, the temperature of the liquid fraction brought to an increased pressure is raised with a nitrogen-rich or oxygen-rich fraction, for example, the sump liquid of the pressure column. Care should be taken so that the quantity, pressure and enthalpy relationships of the heat transfer medium and the liquid fraction are adapted to one another.

The amount of refrigeration offered by the liquid withdrawn from the tank and brought to the increased pressure can be absorbed very well by the liquid flow guided from the rectifying system into the tank. If several liquid products, at least partially internally compressed, are withdrawn from the rectifying system, it may be advantageous for equipment-related reasons to heat one of the internally compressed liquid products with a liquid product of another composition. However, as a rule, heating with the same liquid product is preferred before the internal compression, that is, a heat transfer medium which differs from the internally compressed flow essentially only by its temperature and its pressure.

In addition to the heating of the liquid fraction, which was brought to an increased pressure, with gaseous or liquid products from the rectifying system, the heating of this fraction with the compressed charged air emerging from the main heat exchanger was also found to be advantageous.

Frequently, a throttle flow and gaseous separation air are guided through the main heat exchanger. Expediently, the liquid fraction brought to an increased pressure is heated by the throttle flow emerging from the main heat exchanger. In the case of smaller quantities of liquid to be heated which were brought to an increased pressure, however, the gaseous separation air flow downstream of the main heat exchanger can also be used as the heat transfer medium.

The decision as to which of the above-mentioned heat exchangers is the most suitable in the individual case depends on, among other things, the equipment, that is, the arrangement of the pipes, and the temperature relationships of the participating gas and liquid flows.

If different liquid fractions are obtained by rectification and subsequently internally compressed, it is frequently more advantageous for equipment-related reasons to heat the internal-compression flows in the indirect heat exchange with the compressed charged air. As the result of the amount of charged air, which naturally is much larger in comparison to the products, several internal-compression flows can be heated in a preheat exchanger against the compressed charged air. This permits a simpler construction of the system and saves preheat exchangers.

The use of charged air as the heat transfer medium for heating the internally compressed liquid flows, in addition to the above-mentioned saving of preheat exchangers, always has advantages in comparison to the use of product flows from the rectification particularly when the temperature of the charged air downstream of the main heat exchanger is higher than that of the product flows. If, inversely, the product flows from the rectification system are warmer than the flow of charged air, the internally compressed liquid products are advantageously heated in the indirect heat exchange with these product flows.

The liquid product flows are obtained from the rectification system under a hyperbaric pressure and then introduced into the tanks which are under a normal pressure. During the expansion occurring in this case, a portion of the liquid products will evaporate and will therefore be lost as liquid. During the heating-up of the internally compressed liquids in the heat exchange with the product flows from the rectification system, the latter are cooled before the introduction into the tank, which reduces the above-described losses—the so-called flash losses—during the relaxation of the liquids.

Preferably oxygen and/or nitrogen are withdrawn as liquid products from the rectification system, are guided into a tank, are at least partially removed again from the tank, are compressed in the liquid state of aggregation and are then heated up and evaporated.

It was found that, during a heating-up of the liquid fraction, which was brought to an increased pressure, in the indirect heat exchange with a fraction obtained in the rectifying system, a temperature rise of the liquid fraction, which was brought to the increased pressure, in the preheat exchanger to up to 1 to 1.5 K below the boiling temperature of the fraction obtained in the rectifying system is advantageous. In this manner, a liquefaction of the separation air during the subsequent evaporation of the liquid fraction, which was brought to the increased pressure, in the heat exchanger is avoided and the technical construction of the preheat exchanger and the main heat exchanger can be kept relatively simple.

If the liquid fraction, which is brought to an increased pressure, is heated in the indirect heat exchange with the charged air, particularly with the throttle flow, emerging from the main heat exchanger, higher temperature rises are conceivable. In this case, the liquid fraction, which is brought to an increased pressure, is preferably raised to the same temperature as the other flows guided in the main heat exchanger from the cold end. This results in a simpler design of the main heat exchanger.

In the event of an operating disturbance, according to the invention, a portion of the liquid fraction is removed from the tank and fed to an emergency evaporator. In this case, the liquid flow to the preheat exchanger, which heats the internally compressed liquid in the normal operation, is preferably interrupted. In the emergency evaporator, the liquid fraction is advantageously evaporated with ambient air or water as the heat transfer medium.

In addition to the process for the low-temperature air separation, the present invention also relates to a corresponding arrangement, comprising a rectifying system with a charged air pipe which leads into a main heat exchanger and from it, into the rectifying system, having a pipe for the removal of a liquid fraction from the rectifying system and for its introduction into a tank, having a liquid product pipe for the liquid fraction from the tank to a preheat exchanger, a connection between the preheat exchanger and the main heat exchanger, a product pipe for removing the evaporated liquid fraction as a gaseous pressure product, a device for increasing the pressure of the liquid fraction, which device is arranged in the liquid-product pipe, and a pipe to an evaporating device for the emergency supply which branches off downstream of the devices for increasing the pressure of the liquid fraction.

Advantageously, the preheat exchanger is arranged in the pipe for removing the liquid product from the rectifying system so that the liquid product brought to an increased pressure by means of the device for increasing the pressure is heated by the product guided into the tank from the rectifying system. It is also advantageous to provide the preheat exchanger in the charged air pipe downstream of the main heat exchanger so that the charged air emerging from the main heat exchanger can be utilized for the preheating. In this case, it is particularly advantageous to combine the preheat exchanger and the main heat exchanger to a single component; that is, to provide a heat exchanger block in which different sections carry out the function of the preheat exchanger and those of the main heat exchanger.

Other objects, advantages and novel features of the present invention will become apparent from the following detailed description of the invention when considered in conjunction with the accompanying drawings.

DETAILED DESCRIPTION OF THE DRAWINGS

Figure 1:
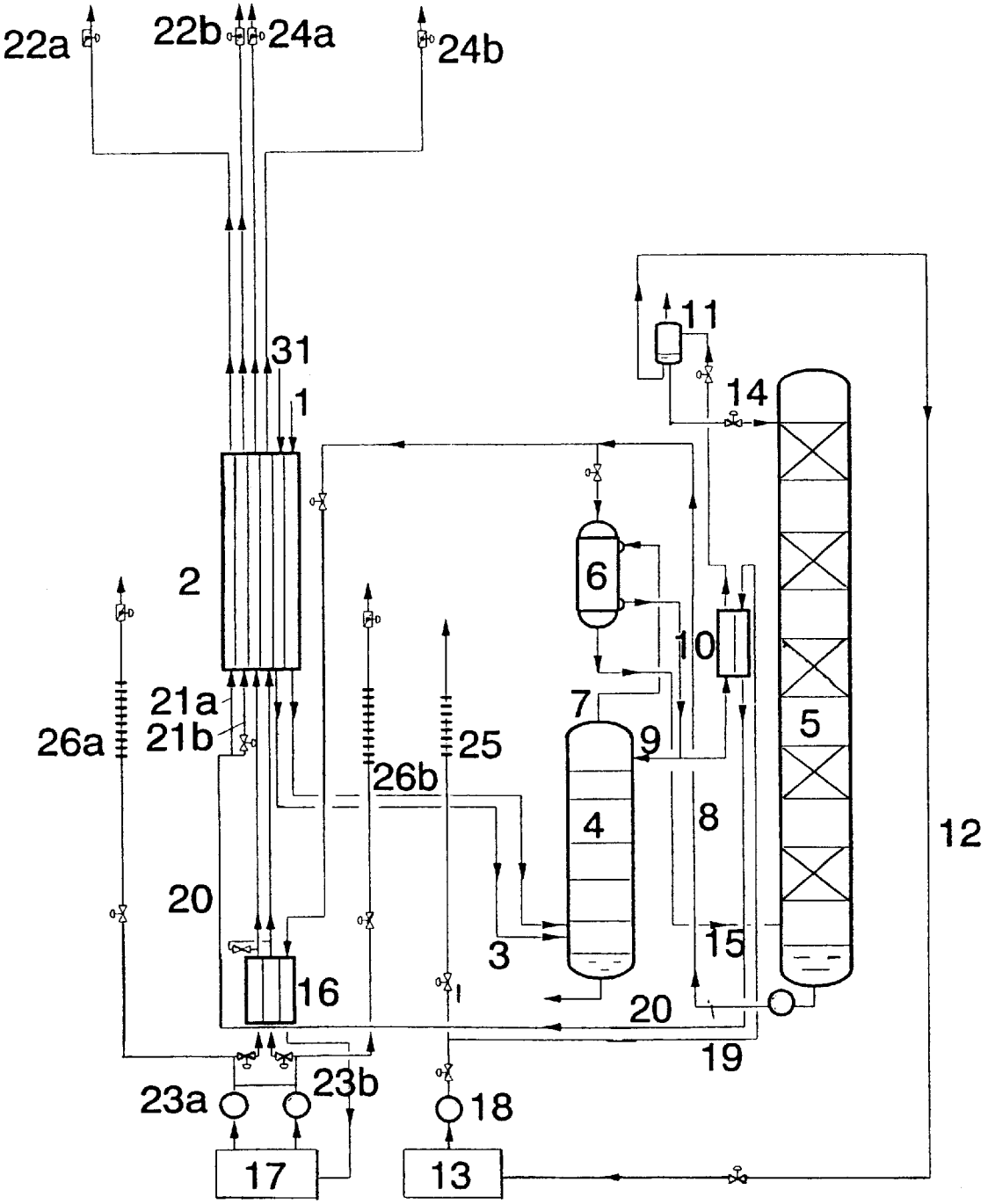
FIG.1 is a schematic view of an air separation system according to a preferred embodiment of the present invention.

The purified charged air is divided into a throttle flow 1, with a pressure of 5 to 70 bar, and a separation air flow 31, compressed to a pressure column pressure, and is introduced into main heat exchanger system 2. The maximum pressure to which the charged air can be compressed is determined by the construction of the main heat exchanger 2. In the main heat exchanger 2, gaseous separation air 31 is cooled approximately to its dew point and is directed by pipe 3 to pressure column 4 of the rectifying system. To the extent permitted by the Q-T course, throttle air flow 1 is also cooled. The rectifying system comprises, among other things, low-pressure column 5 which is operated at a pressure of between 1.1 and 3 bar, preferably between 1.3 to 1.7 bar. The pressure column 4 and low-pressure column 5 are in thermal contact with one another by way of main condenser 6.

Gaseous nitrogen 7 from the head of pressure column 4 is liquified in the main condenser 6 in heat exchange with liquid oxygen. The liquid oxygen is taken from the sump of the low-pressure column 5 by way of pipe 8. The oxygen, which evaporates in this case, is introduced again into the low-pressure column by way of pipe 15. The liquid nitrogen is directed as a reflux liquid 9 to pressure column 4 and is directed to a liquid separator 11 by way of the preheat exchanger 10. A portion of the liquid occur ring in separator 11 is used as reflux liquid 14 for low-pressure column 5; the remaining liquid nitrogen, which is under the head pressure of low-pressure column 5, is expanded by way of pipe 12 into a liquid nitrogen tank 13. In tank 13, the liquid nitrogen is preferably under atmospheric pressure. In the preheat exchanger, the temperature of the nitrogen is lowered so that the evaporation losses are very low which occur as the result of the pressure decrease during the introduction of the liquid nitrogen into tank 13.

From the sump of the low-pressure column 5, liquid oxygen 8 is removed and is partly fed to the main condenser 6 and is partly subcooled in a preheat exchanger 16. The subcooled liquid oxygen is introduced into a liquid-oxygen tank 17 in which the oxygen is stored under atmospheric pressure.

By means of a pump 17, the liquid nitrogen from the tank 13 is brought to a pressure of up to 200 bar and is subsequently guided to the preheat exchanger 10 (pipe 19). In the preheat exchanger 10, the pressure nitrogen, which has a temperature of, for ex ample, 80 K, is heated in the counterflow with the nitrogen withdraw n from the main condenser 6 to approximately 95 K. The thus heated pressure nitrogen is guided by way of pipe 20 to the main heat exchanger 2. In front of the main heat exchanger 2, the pipe 20 branches into the pipes 21*a* and 21*b* leading into the heat exchanger 2. By way of the pipe 21*a*, the nitrogen, which is under a high pressure, is guided directly into the heat exchanger 2, is evaporated there and can subsequently, by way of the pipe 22*a*, be removed as a high-pressure product with a pressure of preferably up to 60 bar. The pressure of the nitrogen guided into the main heat exchanger 2 may also be higher than 60 bar; however, the maximal pressure is determined by the pressure resistance of the heat exchanger 2. In pipe 21*b*, a portion of the pressure nitrogen 20 can be relaxed, can then be evaporated and be removed by way of pipe 22*b* as a gaseous product of medium pressure.

At least a portion of the oxygen stored in the tank 17 is analogously internally compressed by means of the two pumps 23*a* and 23*b*. In the preheat exchanger 16, the two oxygen flows, which were brought to an increased pressure, are heated by the heat exchange with the oxygen flow obtained from the bottom of the low pressure column 5. After the evaporation of the internally compressed oxygen in the main heat exchanger 2, by way of the pipes 24*a* and 24*b*, gaseous oxygen of an increased pressure is withdrawn.

In the event that the proper operation of the system can no longer be maintained, for example, in the event of a failure of a component of the air separation system, the further supply with oxygen and nitrogen is ensured by way of an emergency supply. The emergency supply will also be used if the demand for the gaseous product exceeds the production for a short time. For this purpose, liquid nitrogen is pumped by means of a pump 18 from the tank 13 to a water bath evaporator 25 and is evaporated there. Analogously, by means of the pumps 23*a* and 23*b*, liquid oxygen can be fed to the evaporators 26*a* and 26*b* in which the oxygen is evaporated against ambient air or water.

Figure 2:
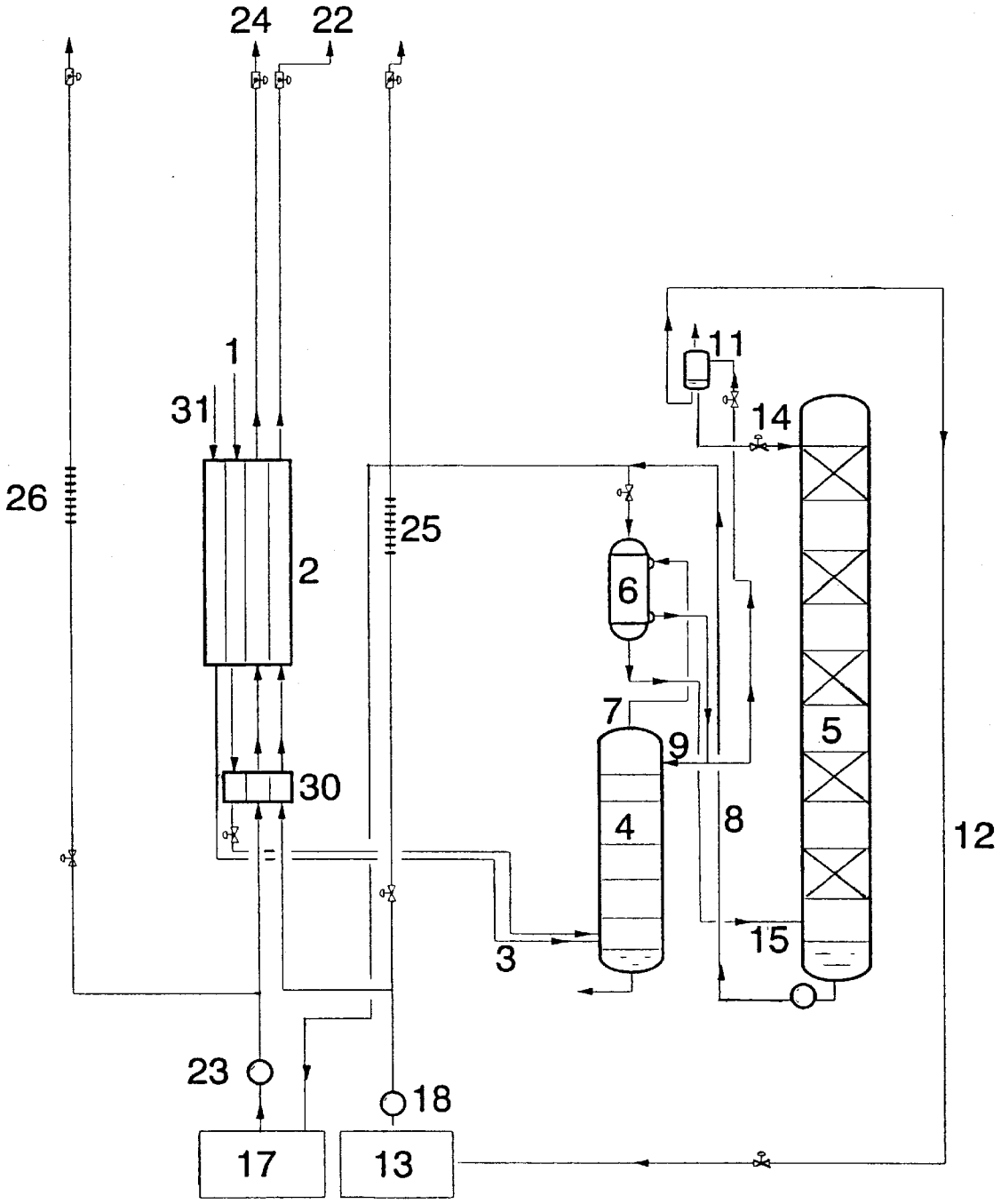
FIG.2 is a schematic view of an air separation system according to another preferred embodiment of the present invention.

FIG. 2 shows a second preferred embodiment of the air separation system according to the present invention. In FIGS. 1 and 2, identical system components have similar reference numbers. The preferred embodiment depicted in FIG. 2 differs from the preferred embodiment depicted in FIG. 1 essentially by the fact that the product flows internally compressed by means of pumps 18 and 23 are heated against the throttle air flow 1 emerging at the cold end of the main heat exchanger 2. The preheat exchangers 10 and 16 for heating the internally compressed nitrogen and oxygen against the corresponding product flows withdrawn from the low-pressure column 5 are eliminated.

The preferred embodiment depicted in FIG. 2 is particularly advantageous if the compressed throttle air emerging from the main heat exchanger 2 is warmer than the rectification products. Thus, a better preheating of the liquid products, which are under an increased pressure, is achieved and the equipment-related expenditures are reduced because, instead of two preheat exchangers, only one preheat exchanger is required.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

We claim:

1. A process for the low-temperature separation of air by rectification, comprising the acts of:

(A) cooling compressed, charged air in a main heat exchanger and directing it to a rectifying system;

(B) storing in a tank a liquid fraction obtained from the rectifying system;

(C) removing at least a first portion of the liquid fraction from the tank and placing the first portion under an increased pressure;

(D) during normal operation, under an increased pressure, heating the liquid fraction in a preheat exchanger and then evaporating the liquid fraction in the main heat exchanger, yielding a product gas at an increased pressure;

(E) during an operating disturbance, removing from the tank at least a second portion of the liquid fraction, evaporating and using the second portion for an emergency supply; and (F) during normal operation, heating the liquid fraction, placed under the increased pressure, in an indirect heat exchange in the preheat exchanger with a fraction obtained in the rectifying system.

2. The process according to claim 1, further comprising:

(G) guiding the fraction obtained in the rectifying system into the tank.

3. The process according to claim 1, further comprising:

(F) during normal operation, heating the liquid fraction, placed under the increased pressure, in an indirect heat exchange with the compressed charged air emerging from the main heat exchanger.

4. The process according to claim 1, wherein oxygen is obtained as the liquid fraction.

5. The process according to claim 1, wherein nitrogen is obtained as the liquid fraction.

6. The process according to claim 1, wherein, in the event of the operating disturbance, the liquid fraction is evaporated in the indirect heat exchange with air or water.

7. The process according to claim 1, wherein oxygen is obtained as the liquid fraction.

8. The process according to claim 2, wherein oxygen is obtained as the liquid fraction.

9. The process according to claim 3, wherein oxygen is obtained as the liquid fraction.

10. The process according to claim 1, wherein nitrogen is obtained as the liquid fraction.

11. The process according to claim 2, wherein nitrogen is obtained as the liquid fraction.

12. The process according to claim 3, wherein nitrogen is obtained as the liquid fraction.

13. The process according to claim 1, wherein, in act (E), the liquid fraction is evaporated in an indirect heat exchange with air or water.

14. The process according to claim 2, wherein, in act (E), the liquid fraction is evaporated in an indirect heat exchange with air or water.

15. The process according to claim 3, wherein, in act (E), the liquid fraction is evaporated in an indirect heat exchange with air or water.

16. A system for a low-temperature separation of air, comprising:

a rectifying system, a tank, a main heat exchanger, and a preheat exchanger;

a first pipe, for charged-air, connecting the main heat exchanger and the rectifying system;

a second pipe for directing a liquid fraction from the rectifying system to the tank;

a third pipe, for liquid products, for directing the liquid fraction from the tank to the preheat exchanger;

a connection between the preheat exchanger and the main heat exchanger;

a fourth pipe, for products, for removing the evaporated liquid fraction as a gaseous pressure product from the main heat exchanger;

a device for increasing the pressure of the liquid fraction arranged in the third pipe;

a fifth pipe to an evaporation device for the emergency supply which branches off the third pipe downstream of the device for the pressure increase of the liquid fraction; and wherein the preheat exchanger is not connected to the first pipe or any other pipe for conducting charged air.

17. The system according to claim 16, wherein the preheat exchanger is arranged in another pipe for removing the liquid fraction from the rectifying system.

18. The system according to claim 16, wherein the preheat exchanger is arranged in the first pipe downstream of the main heat exchanger.

* * * * *